US010212981B2

(12) United States Patent
Burek et al.

(10) Patent No.: US 10,212,981 B2
(45) Date of Patent: Feb. 26, 2019

(54) HELMET

(71) Applicant: Charles Owen & Company (Bow) Limited, Rhostyllen, Wrexham (GB)

(72) Inventors: Roy O. Burek, Chester (GB); Matthew Stewart, Flintshire (GB)

(73) Assignee: Charles Owen & Company (Bow) Limited, Rhostyllen, Wrexham (GB)

( * ) Notice: Subject to any disclaimer, the term of this patent is extended or adjusted under 35 U.S.C. 154(b) by 610 days.

(21) Appl. No.: 14/657,122

(22) Filed: Mar. 13, 2015

(65) Prior Publication Data

US 2015/0257472 A1 Sep. 17, 2015

(30) Foreign Application Priority Data

Mar. 14, 2014 (GB) ..... 1404598.3

(51) Int. Cl.
*A42B 1/06* (2006.01)
*A42B 3/00* (2006.01)
(Continued)

(52) U.S. Cl.
CPC ..... *A42B 3/125* (2013.01); *A42B 3/064* (2013.01); *A42B 3/08* (2013.01)

(58) Field of Classification Search
CPC .. A42B 3/00; A42B 3/06; A42B 3/063; A42B 3/064; A42B 3/125; A42B 3/10; A42B 3/12; A63B 71/10
(Continued)

(56) References Cited

U.S. PATENT DOCUMENTS 4,064,565 A * 12/1977 Griffiths ..... A42B 3/121 2/412
4,307,471 A * 12/1981 Lovell ..... A42B 3/065 2/411

(Continued)

FOREIGN PATENT DOCUMENTS

WO 2004/032659 A1 4/2004
WO 2011/087435 A1 7/2011
WO 2011/139224 A1 11/2011

OTHER PUBLICATIONS

GB Search Report dated Sep. 15, 2014 in GB Application No. 1404598.3.

(Continued)

*Primary Examiner* — Jameson D Collier
(74) *Attorney, Agent, or Firm* — Collard & Roe, P.C.

(57) ABSTRACT

A helmet 100 includes a helmet shell 16, an outer liner layer 14 fixed inside the helmet shell 16; and an inner liner layer 12 positioned against the outer liner layer 14; the outer liner layer 14 having a dome-like concave curved internal surface; the inner liner layer 12 having a dome-like convex curved external surface; the said surfaces of the inner and outer liner layers 12, 14 being substantially spherical where they overlap for allowing rotational sliding movement of the inner liner layer against the outer liner layer; a rotation-limiting mechanism being provided for limiting rotation between the inner and outer liner layers; and at least one of the said surfaces of the inner and outer liner layers 12, 14 having recesses 18 therein for weakening the layer and for facilitating crushing of the layer when a sufficiently large radial force is applied, loosening the inner liner layer 12 within the outer liner layer 14.

20 Claims, 3 Drawing Sheets

(51) Int. Cl.

| | |
|---|---|
| ***A63B 71/10*** | (2006.01) |
| ***A42B 3/12*** | (2006.01) |
| ***A42B 3/06*** | (2006.01) |
| ***A42B 3/08*** | (2006.01) |

(58) Field of Classification Search
USPC ..... 2/410–412, 414, 425
See application file for complete search history.

(56) References Cited

U.S. PATENT DOCUMENTS

| | | | | |
|---|---|---|---|---|
| 6,658,671 | B1 * | 12/2003 | Von Holst | A42B 3/12 2/412 |
| 9,388,873 | B1 * | 7/2016 | Phipps | B60R 19/28 |
| 2001/0032351 | A1 | 10/2001 | Nakayama et al. | |
| 2004/0117896 | A1 * | 6/2004 | Madey | A42B 3/064 2/411 |
| 2004/0250340 | A1 * | 12/2004 | Piper | A42B 3/064 2/411 |
| 2006/0059606 | A1 * | 3/2006 | Ferrara | A01N 25/18 2/412 |
| 2012/0060251 | A1 | 3/2012 | Schimpf | |
| 2012/0096631 | A1 | 4/2012 | King et al. | |
| 2012/0297526 | A1 * | 11/2012 | Leon | A42B 3/12 2/413 |
| 2013/0061371 | A1 * | 3/2013 | Phipps | A42B 3/064 2/411 |
| 2013/0185837 | A1 * | 7/2013 | Phipps | A42B 3/12 2/2.5 |
| 2014/0013492 | A1 * | 1/2014 | Bottlang | A42B 3/125 2/414 |
| 2015/0264991 | A1 * | 9/2015 | Frey | A63B 71/10 2/411 |
| 2016/0242485 | A1 * | 8/2016 | Carton | A63B 71/10 |

OTHER PUBLICATIONS

European Search Report dated Jul. 24, 2015 in European Application No. EP 15 15 9103.

* cited by examiner

HELMET

CROSS REFERENCE TO RELATED APPLICATIONS

This application hereby claims priority under 35 U.S.C. 119 from GB 1404598.3 filed on Mar. 14, 2014 the disclosure of which is hereby incorporated herein by reference in its entirety.

BACKGROUND TO THE INVENTION

The present invention relates to a helmet which is designed to absorb more energy during an impact, particularly rotational energy, with the aim of reducing brain trauma.

It is known that helmets provide protection against brain injury when they absorb energy in an impact. However, the protection provided is sometimes not sufficient to protect against brain damage, especially if the impact is particularly severe. Attention has recently been focused on protecting the head during oblique impacts, in which both linear and rotational forces are experienced.

During a fall, the head has a combination of linear and rotational energy. Upon impact, this energy has to be transferred, and the time duration of the transfer is often under 10 milliseconds. The brain floats inside the skull in cerebrospinal fluid and can move independently of the skull to a certain degree. The brain will continue to move after the skull has come to rest or reversed direction. As the brain decelerates, strain and shear forces are created which can cause structural damage to the brain, and/or set off a pathophysiological cascade of chemical processes that can lead to neuron and glial death.

The object of a helmet is to reduce peak acceleration, which in turn reduces the strain and shear forces on the brain during an impact, limiting brain damage.

A problem of existing helmet designs is that the response time of the helmet system may be too slow to limit the rotational acceleration, and there may be no rotational energy absorption to prevent serious injury. The greatest increase in acceleration is generally in the first microseconds of an impact, and so fast response time is critical if the peak acceleration is to be reduced.

As described in WO 2011/139224, it is known to provide a helmet having an inner liner layer and an outer liner layer, the inner liner layer being rotatable within the outer liner layer. In this way, rotational acceleration of the brain can be reduced, because the outer liner layer of the helmet will rotate, 'slipping' with respect to the inner liner layer. The layers are held together by fixation members between the layers, which deform plastically or elastically to allow rotation when needed. However, the fixation members slow the response time of the helmet, and limit the maximum rotation between the layers. This reduces the effectiveness of the helmet.

The deformation of the fixation members is also the primary mechanism by which rotational energy is absorbed by the helmet. The helmet's capacity to absorb energy is therefore limited. If a fixation member breaks in a serious fall, then it will not be able to absorb any more energy after it has broken.

A further problem with existing helmet designs is that, to provide inner and outer 'slip' layers, either the overall size of the helmet must be increased, which may be uncomfortable and/or unsightly, or the amount of padding for absorbing the energy in radial impacts has to be reduced. It is clear from FIG. 1 in WO2011/139224 that a gap must be provided between the inner and outer liner layers, and increased performance in arresting rotational forces is therefore at the cost of decreased performance in arresting radial forces. Regardless of safety considerations, consumers will tend to prefer good-looking and comfortable helmets.

It is an object of this invention to provide an improved helmet which more effectively protects against both linear and rotational impacts, without the need for substantial extra bulk in the helmet.

SUMMARY OF THE INVENTION

According to the present invention there is provided a helmet comprising a helmet shell, an outer liner layer fixed inside the helmet shell; and an inner liner layer positioned against the outer liner layer;

the outer liner layer having a dome-like concave curved internal surface;

the inner liner layer having a dome-like convex curved external surface;

the outer and inner liner layers each including front, back, and two lateral side wall sections, in which the lateral side wall sections of the outer liner layer are substantially truncated compared with the inner liner layer, the said surfaces of the inner and outer liner layers being substantially spherical where they overlap for allowing rotational sliding movement of the inner liner layer against the outer liner layer; and a rotation-limiting mechanism being provided for limiting rotation between the inner and outer liner layers.

At least one of the said surfaces of the inner and outer liner layers may have recesses therein for weakening the layer and for facilitating crushing of the layer when a sufficiently large radial force is applied, loosening the inner liner layer within the outer liner layer.

Various types of helmets may incorporate the invention, and the structure of the various parts will depend on the type of helmet. For example, in a horse riding helmet the outer shell will usually be rigid and fairly thick, whereas a cycle helmet usually has a thin and relatively flexible outer shell. All helmets must include means for holding the helmet onto the head, which is usually a chin strap. If the helmet is allowed to rotate too much, then the chin strap may twist and suffocate the wearer. It is therefore vital that means are provided for limiting the amount of rotation between the layers.

Preferably, the helmet includes a flexible textile member across bottom edges of the inner and outer liner layers, which may further extend to or across the bottom edge of the outer shell. The flexible textile member forms a headband, which holds the layers of the helmet together. The headband may provide the means by which rotation between the inner and outer liner layers is limited, and as such it may be made from a substantially elastic material, for example elastane sold under the registered trade mark LYCRA®. Using an elastic headband for limiting rotation between the layers is particularly advantageous, because the headband at its central unstretched position gives very little resistance to rotation, making for a helmet with a very fast response during an impact. However, as the helmet rotates, the resistance provided by the elastic headband increases, gradually slowing the rotation.

In some embodiments, the elastic headband may be attached only around the inside edge of the inner liner layer, and may stretch all the way over the outer liner layer. In such an embodiment, the elastic headband and the helmet shell are in fact the same component. Alternatively, the elastic headband may be taped or otherwise bonded to the inner liner layer and to the outer shell. Also, the elastic headband may extend all the way over the outer shell, essentially providing the helmet with a secondary skin in addition to the main outer shell.

The inner liner layer includes front, back, and two lateral side wall sections which in use extend substantially vertically around the front, back and sides of a wearer's head. The outer liner layer includes corresponding front, back and side wall sections, but the side sections of the outer liner layer is substantially truncated as compared to the inner liner layer. In other words, a significant area around the sides of the helmet liner is formed of a single (inner) layer which is positioned directly against the outer shell of the helmet.

The structure and shape of the inner and outer liner layers and the outer shell may provide a further mechanism for limiting and slowing rotation. It is generally preferable to have a helmet the overall shape of which is ovaloid rather than spherical, since this better matches the shape of the head, and makes for a helmet which is more attractive and comfortable to wear. At the same time, an ovaloid outer shell can be used to provide resistance to the rotation of a part-spherical inner liner layer. Lateral sides of the outer liner layer are truncated, so that the inner liner layer only moves against the outer liner layer at the front, rear, and top of the helmet. At the sides, the inner liner layer may be positioned directly against the outer shell. The parts of the inner liner layer which are positioned directly against the outer shell may not be spherical. Therefore the inner liner layer cannot move against the ovaloid outer shell unless either the inner liner layer or the ovaloid outer shell deforms in some way.

The configuration described above prevents rotation of the inner liner layer about an axis (referred to as the Z axis) through the top of the helmet, but allows rotation (limited by the headband or another rotation-limiting mechanism) about orthogonal X and Y axes which run from the front to the back and between the lateral sides of the helmet. However, if the inner liner layer is made from a compressible material, for example expanded polystyrene, then it may rotate within the helmet shell if there is a rotational force of sufficiently high magnitude, because the inner liner layer will compress or degrade as its surface scrapes or grinds against the interior of the helmet shell. In other words, the outer surface of the inner liner layer may crush and absorb energy as it turns into the ovaloid shape of the outer shell, limiting the peak acceleration about the Z axis. Alternatively it may be the outer shell which deforms to allow rotation of the inner liner layer about the Z axis, especially if the outer shell is flexible and elastic, for example because it is formed as the same part as the elastic headband.

Also, the relative shape of the inner and outer liner layers may be such that rotation of the inner liner layer about the Z axis causes bending of the front and back walls of the outer liner layer.

In the preferred embodiment, the elastic headband is the primary means of limiting and slowing rotation in the X and Y axes, but the crushing of the outer surface of the inner liner layer against the helmet shell is the primary means of limiting rotation in the Z axis. However, the elastic headband will also act to absorb rotational energy in the Z direction.

Generally, there is a need to restrict movement about the Z axis to a far greater extent than about the X and Y axes. This is because the chin strap of the helmet may tangle and suffocate the wearer, if too much rotation is allowed about the Z axis.

It will be appreciated that the degree to which movement is restricted can be varied by the use of different materials in the elastic headband, by pre-tensioning the elastic headband, or by varying the shape of the inner liner layer and helmet shell.

If the wearer of the helmet experiences a relatively low-magnitude oblique impact to the head, the layers will rotate against each other to reduce peak rotational acceleration on the head. The radial components of the impact force will be absorbed by the layers, primarily by plastic and elastic deformation of the helmet liner in the same way as a traditional helmet.

If the oblique impact is more serious, the radial components of the force will act to crush the weakened region of the inner and/or outer liner layer. The crushing of the layer provides further protection against the radial impact by absorbing energy by plastic deformation of the helmet liner. Also, the crushing of the weakened area changes the shape of the corresponding surface(s) of the inner and/or outer liner layers, loosening the inner liner layer of the helmet liner within the outer liner layer. The degree to which the helmet liner is able to rotate is therefore increased, providing greater protection against the rotational (tangential) components of the more serious oblique impact.

A traditional helmet likewise absorbs energy in a severe impact by plastic deformation of the liner. However, the amount of energy which can be absorbed in this way is increased when recesses are provided. The greatest force on the helmet liner, during an accident, is generally near the interior and exterior surfaces of the helmet, as the helmet is "pincered" between the head and the ground. The helmet absorbs the greatest amount of energy in these areas, and particularly near the outer surface, because the force in these places is sufficient to plastically deform the material. Towards the centre of the helmet, between the inner and outer surfaces, the force is reduced. At some point this force will drop below the plastic deformation threshold of the helmet liner. After this point, the helmet's ability to absorb energy is substantially reduced. In the helmet described, however, the weakened region provides for a helmet liner which plastically deforms through substantially the whole thickness of the helmet, therefore absorbing more energy.

The helmet liner protects against radial and tangential components of force in an oblique impact. It has a very fast response time due to the rotatable inner and outer liner layers. Rotation begins within the first few picoseconds of an impact. The helmet adapts depending on the magnitude of an oblique impact, the inner liner layer becoming progressively looser within the outer liner layer and the helmet shell to provide an appropriate amount of rotation in the helmet liner to give the best protection. In a medium- to high-magnitude impact, the helmet liner deforms to reduce the resistance to rotation between the inner and outer liner layers, depending on the actual magnitude of the oblique impact. Since no fixation members or other components are required to be positioned between the layers, which rotate directly against each other, the mechanism for rotational protection is not at the cost of decreased padding for protection against radial blows. A helmet incorporating the invention may be substantially similar to traditional helmets in terms of size, shape, and outward appearance.

As well as providing a weakened area for collapsing of the helmet liner, as described above, the recesses reduce the contact area between the inner and outer liner layers, allowing smooth sliding. In a particularly serious impact, the ribs collapse as described above, which reduces both the radial force between the inner and outer liner layers and the contact area between the layers. This reduced the friction between the layers and allows more unrestricted movement.

Preferably, the inner and outer liner layers of the helmet liner are formed of expanded polystyrene. Alternative suitable materials include polyurethane, polypropylene, polyethylene and copolymer mixes of any of these materials mentioned.

The skilled person will appreciate that the recesses can be arranged in various configurations to provide the required weakened areas of the inner and outer liner layers. However, the preferred arrangement is for recesses to be provided on the interior surface of the outer liner layer, and for the recesses to be substantially elongate defining ridges or ribs therebetween, the recesses (and ribs) being along arcs on the surface which project onto the X-Y plane parallel to the X and/or Y axes. In other words, recesses/ribs are preferably oriented in a front-to-back or side-to-side orientation on the surface of the outer liner layer.

In one preferred embodiment, recesses run side-to-side in a central area around half way between the front and back of the surface of the outer shell, and further recesses run front-to-back in front of and behind the central area. The front-to-back recesses are essentially interrupted by the side-to-side recesses in the central area, so that recesses do not cross over but form elongate channels.

In another aspect, the helmet liner includes an outer liner layer for fixing inside a helmet shell; and an inner liner layer positioned against the outer liner layer;

the outer liner layer having an internal surface and the inner liner layer having an external surface;

and at least one of the said surfaces of the inner and outer liner layers having recesses therein for creating a weakened region in the helmet liner.

As described above, providing a weakened region in the centre of a helmet liner, between the inner and outer surfaces, allows the helmet liner to absorb energy from an impact by plastic deformation throughout substantially the entire thickness of the liner. The inner and outer liner layers are rotatable against each other.

The recesses may be a plurality of elongate slots and are preferably formed in the internal surface of the outer liner layer. The slots may be oriented in a front-to-back or side-to-side orientation on the surface of the inner and/or outer liner layer(s), which may be made from expanded polystyrene.

The helmet liner may be incorporated into a helmet having a helmet shell.

BRIEF DESCRIPTION OF THE DRAWINGS

The invention will now be more particularly described, by way of example only, with reference to the accompanying drawings, in which.

DESCRIPTION OF PREFERRED EMBODIMENT(S)

Figure 1A:
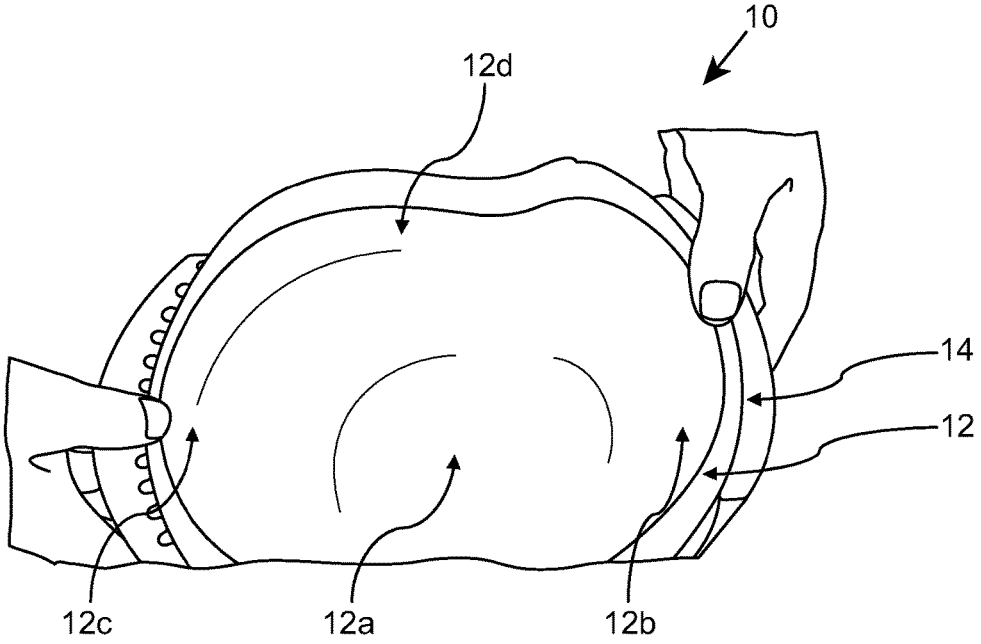
FIG. 1*a* shows a perspective view of a helmet liner according to the invention, the inner and outer liner layers being located in a substantially central position.
Figure 1B:
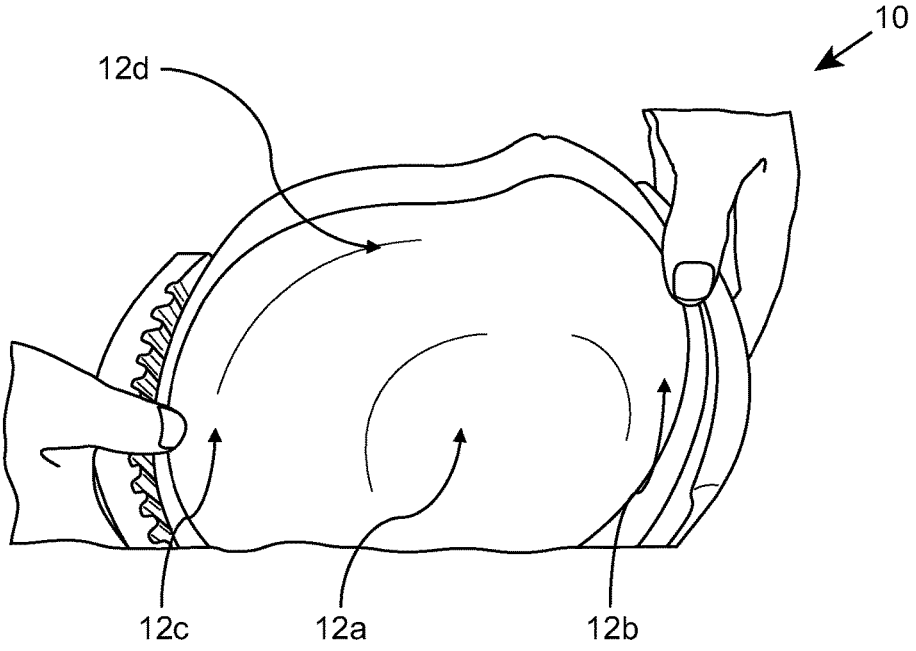
FIG. 1*b* shows a perspective view of the helmet liner of FIG. 1*a*, the inner liner layer having been rotated within the outer liner layer.

Referring firstly to FIGS. 1*a* and 1*b*, a helmet liner is indicated generally at 10. The liner includes an inner liner layer 12 which is positioned against and rotatable within an outer liner layer 14. In FIG. 1*b* the inner liner layer 12 is seen rotated about the Y axis as indicated on the Figures, but it can also be rotated about the X axis in the same way. The outer surface of the inner liner layer and the inner surface of the outer liner layer are substantially spherical where they overlap, allowing rotation of the surfaces against each other. There are no components disposed between the inner and outer liner layers. The liner 10 is designed to fit within a helmet shell 16, seen in FIG. 4.

Figure 2:
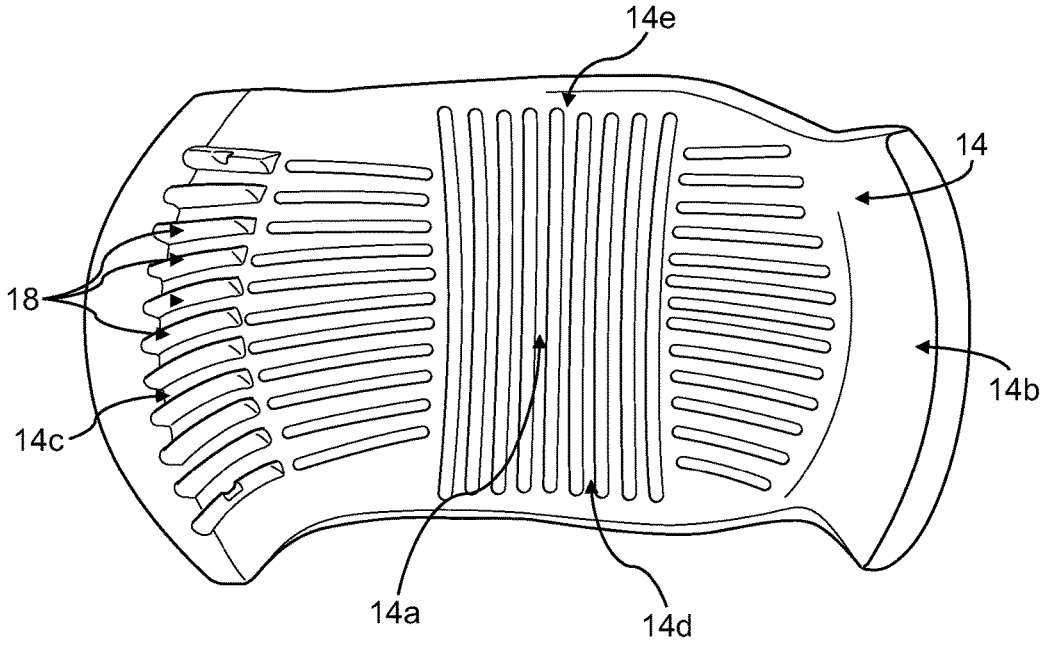
FIG. 2 shows the interior surface of the outer liner layer of the helmet liner of FIGS. 1*a* and 1*b;*
Figure 3:
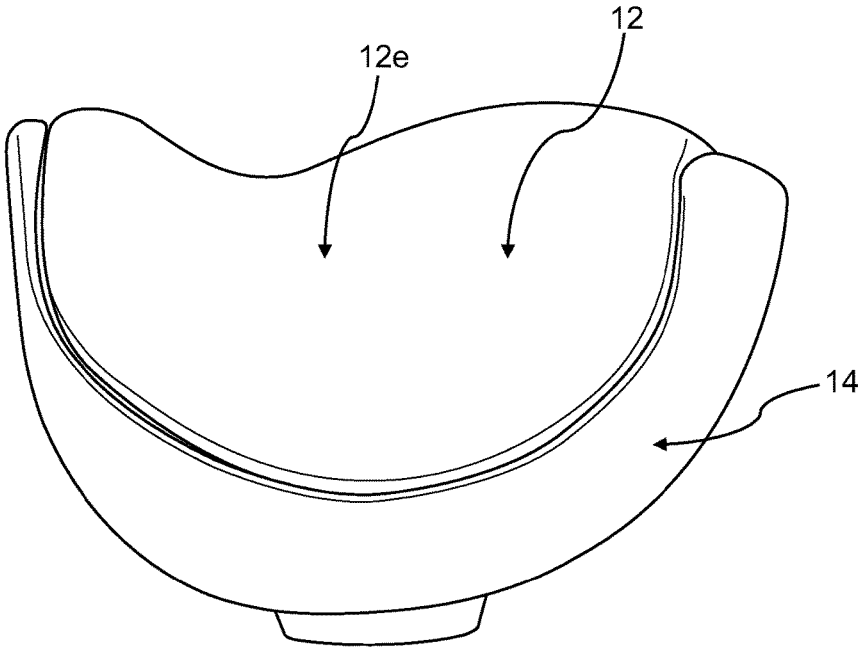
FIG. 3 shows a side view of the helmet liner of FIGS. 1*a* and 1*b;*

FIGS. 2 and 3 more clearly show the shape of the inner 12 and outer 14 liner layers. In particular, from FIG. 2 it can be seen that the outer liner layer 14 includes a central section 14*a*, which in use is at the top of the helmet, above the wearer's head. A front wall section 14*b* and a rear wall section 14*c* extend from the central section 14*a*, the front and rear wall sections 14*b*, 14*c* being substantially vertical, in front and behind a wearer's head in use. The outer liner layer 14 also includes lateral side sections 14*d* and 14*e*. FIG. 2 shows that the lateral side sections 14*d*, 14*e* are substantially truncated, and do not extend a significant vertical distance down the sides of the wearer's head in use.

The central portion and the front, back and lateral side wall portions of the inner liner layer are similarly labelled 12*a*, 12*b*, 12*c*, 12*d*, 12*e*.

Figure 4:
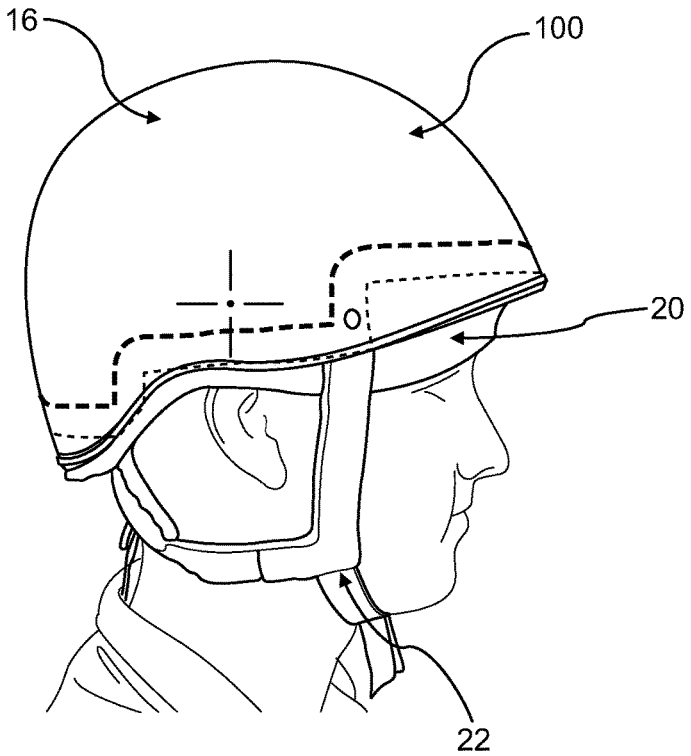
FIG. 4 shows a helmet incorporating the helmet liner of FIGS. 1*a* and 1*b*, in use on a person's head.

It is clear from FIG. 2 that the interior surface of the outer liner layer is not the same shape as the exterior surface of the outer liner layer. The interior surface is substantially spherical, where it rotates against the inner liner 12. The exterior surface is substantially ovaloid, to conform with the shape of the outer shell 16 which is seen in FIG. 4. Likewise, as seen in FIGS. 1*a* and 1*b*, the inner liner 12 has a substantially ovaloid interior shape for conforming to the shape of a human head. The exterior shape of the inner liner 12 is substantially spherical where it overlaps with the outer liner layer, but at the lateral sides in the positions where the outer liner layer is cut away, the spherical shape of the surface is interrupted. The overall shape of the inner and outer liners, joined together, is substantially ovaloid for fitting inside a helmet shell 16 of that general shape.

A lower edge of each lateral side wall section of the outer liner layer 14 includes a curve extending towards an apex of the helmet 100, wherein the outer liner layer 14 has a total height, wherein a peak of the curve of each lower edge is located within a top half of the total height, wherein a midpoint of the curve of each lower edge is located within the top half of the total height, and wherein two endpoints of the curve of each lower edge are located within a bottom half of the total height.

Because the helmet liner 10 as a whole has substantially ovaloid exterior and interior surfaces, but the interface surfaces between the inner and outer liner layers 12, 14 are substantially spherical, the outer liner layer 14 has generally thicker front and back end walls 14*b*, 14*c*, whereas the inner liner layer has generally thicker lateral side walls 12*d*, 12*e*.

Recesses 18 are provided in the interior surface of the outer liner layer 14. In this embodiment, the recesses 18 are elongate slots and all the recesses run in straight lines on the X-Y plane, projected onto the curved surface of the outer liner layer 14. Recesses run between the lateral sides 14*d*, 14*e* of the outer liner layer 14 and between the front and back edges of the outer liner layer. Other arrangements of recesses are possible, but this arrangement is found to be particularly advantageous.

FIG. 3 shows a side view of the complete helmet liner 10, and shows the substantial portion of the side wall 12*e* of the inner liner layer 12 which is not positioned against the interior surface of the outer liner layer 14. When the liner forms part of a helmet, as shown in FIGS. 4 and 5, this part of the inner liner layer is disposed directly against the hard outer shell 16.

Figure 5:
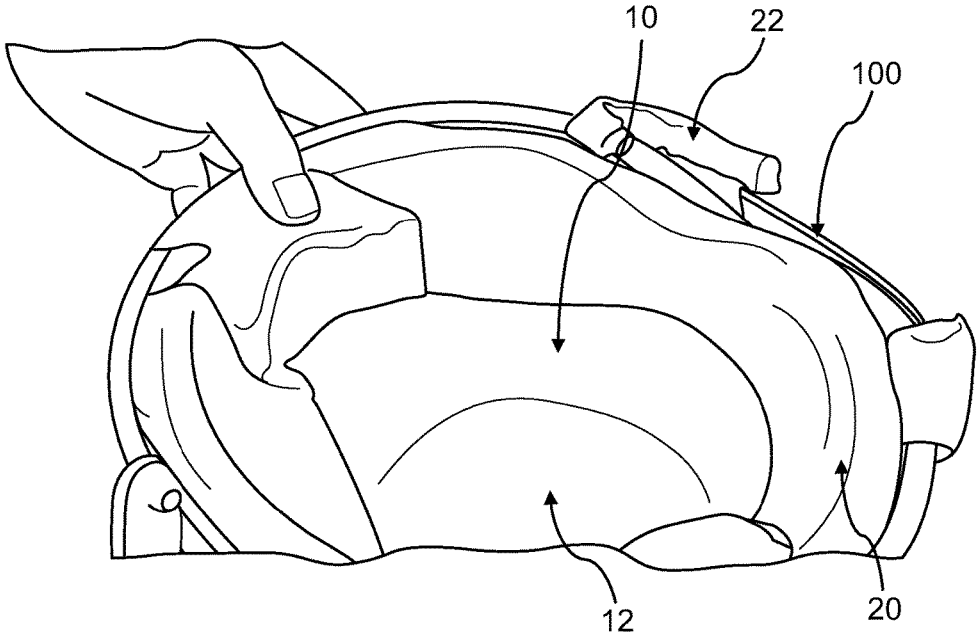
FIG. 5 shows an underside view of the helmet of FIG. 4.

FIGS. 4 and 5 show a complete helmet 100 which incorporates the helmet liner 10. This embodiment includes a hard outer shell 16, and is particularly designed for use in horse riding. The outer appearance of the helmet is a similar in size and shape to many known horse riding helmets.

It is envisaged that different types of outer shell 16 may be provided for different types of helmet. For example, a cycle helmet incorporating the invention may have a much thinner and more flexible outer shell than the hard outer shell 16 shown in this embodiment.

The helmet 100 further includes an elastane headband 20, which is fixed around an edge of the interior surface of the inner liner layer 12 and around an edge of the outer surface of the outer liner layer 14. In other words, the elastane headband 20 holds the inner and outer liner layers 12, 14 together at their edges, and stretches as the layers 12, 14 rotate with respect to each other. In this way, the elastane headband 20 provides increasing resistance to rotation as the layers rotate relative to each other during an impact and acts as an elastic connector.

A chin strap 22 is provided for holding the helmet on the wearer's head. The chin strap 22 is of a common design for horse riding helmets.

In use, during an impact, the helmet protects the head against rotational forces by providing an extremely fast response to reduce peak rotational acceleration. The elastane headband and scraping of the outer liner layer 14 against the helmet shell 16 absorb the rotational forces, protecting the head. If the impact is particularly severe, the ribs formed between the recesses 18 in the outer liner layer 14 will collapse, loosening the rotational interface between the layers 12, 14 and reducing the resistance to rotation.

At the same time, the ribs between the layers increase the performance of the helmet in terms of protection from radial impact. The ribs form a weakened region between the outer and inner surfaces of the helmet, allowing the helmet liner to absorb energy by plastic deformation substantially throughout its entire thickness.

The words "comprises/comprising" and the words "having/including" when used herein with reference to the present invention are used to specify the presence of stated features, integers, steps or components, but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined by the appended claims.

What is claimed is:

1. A helmet comprising:

an ovaloid-shaped helmet shell, an outer liner layer fitted inside the helmet shell; and an inner liner layer positioned against the outer liner layer;

the outer liner layer having a concave curved internal surface;

the inner liner layer having a convex curved external surface;

the outer and inner liner layers each including a front wall section, a back wall section, and two lateral side wall sections, in which the lateral side wall sections of the outer liner layer are truncated compared with the inner liner layer and compared with the front and back wall sections of the outer liner layer;

wherein a lower edge of each lateral side wall section of the outer liner layer includes a curve extending towards an apex of the helmet, wherein the outer liner layer has a total height, wherein a peak of the curve of each lower edge is located within a top half of the total height, wherein a midpoint of the curve of each lower edge is located within the top half of the total height, and wherein two endpoints of the curve of each lower edge are located within a bottom half of the total height;

said surfaces of the inner and outer liner layers being spherical where said surfaces of the inner and outer liner layers overlap for allowing rotational sliding movement of the inner liner layer against the outer liner layer; and a rotation-limiting mechanism connecting the inner and outer liner layers together, the rotation-limiting mechanism being provided for limiting rotation between the inner and outer liner layers.

2. A helmet as claimed in claim 1, in which at least one of the internal surface of the outer liner layer and the external surface of the inner liner layer has recesses therein for weakening the layer and for facilitating crushing of the layer when a radial force is applied, thereby loosening the inner liner layer within the outer liner layer.

3. A helmet as claimed in claim 2, in which the recesses are a plurality of elongate slots.

4. A helmet as claimed in claim 3, in which the slots are oriented in a front-to-back or side-to-side orientation on one or both of the external surface of the inner liner layer and the internal surface of the outer liner layer(s).

5. A helmet as claimed in claim 2, in which the recesses are formed in the internal surface of the outer liner layer.

6. A helmet as claimed in claim 1, in which the inner and outer liner layers are made from expanded polystyrene.

7. A helmet as claimed in claim 1, in which the lateral side wall sections of the inner liner layer have a non-spherical surface where the outer liner layer is truncated relative to the inner liner layer.

8. A helmet as claimed in claim 1, in which the helmet shell has an interior surface which is non-spherical.

9. A helmet as claimed in claim 8, in which the interior surface of the helmet shell is ovaloid.

10. A helmet as claimed in claim 1, including a chin strap.

11. A helmet as claimed in claim 1, in which the rotation-limiting mechanism for limiting rotation is at least one elastic connector which extends from the inner liner layer to the outer liner layer, across bottom edges of the respective layers.

12. A helmet as claimed in claim 11, in which the at least one elastic connector is an at least one elastic headband.

13. A helmet as claimed in claim 12, in which the at least one elastic headband extends to or across a bottom edge of the helmet shell.

14. A helmet as claimed in claim 11, in which the at least one elastic connector is part of the helmet shell or part of an additional outer liner layer, and the at least one elastic connector extends over an external surface of the outer liner layer.

15. A helmet as claimed in claim 11, in which the at least one elastic connector is made from elastane.

16. A helmet as claimed in claim 1, in which the helmet shell is rigid.

17. A helmet as claimed in claim 1, in which the helmet shell is flexible.

18. A helmet comprising:

an ovaloid-shaped helmet shell, an outer liner layer fitted inside the helmet shell;

an inner liner layer positioned against the outer liner layer;

the outer liner layer having a concave curved internal surface, the outer liner layer having a front wall section, a back wall section, and two lateral side wall sections;

the inner liner layer having a convex curved external surface;

said surfaces of the inner and outer liner layers being spherical where said surfaces of the inner and outer liner layers overlap for allowing rotational sliding movement of the inner liner layer against the outer liner layer;

the helmet shell having a non-spherical interior surface, and the outer liner layer being rotatable against the non-spherical interior surface of the helmet shell for absorbing rotational forces;

wherein a lower edge of each lateral side wall section of the outer liner layer includes a curve extending towards an apex of the helmet, wherein the outer liner layer has a total height, wherein a peak of the curve of each lower edge is located within a top half of the total height, wherein a midpoint of the curve of each lower edge is located within the top half of the total height, and wherein two endpoints of the curve of each lower edge are located within a bottom half of the total height; and at least one elastic connector comprising a stretchable rotation-limiting member connecting the inner and outer liner layers together, the stretchable rotation-limiting member being provided for limiting rotation between the inner and outer liner layers.

19. A helmet comprising:

an ovaloid-shaped helmet shell, an outer liner layer fitted inside the helmet shell; and an inner liner layer positioned against the outer liner layer;

the outer liner layer having a concave curved internal surface;

the inner liner layer having a convex curved external surface;

the outer and inner liner layers each including a front wall section, a back wall section, and two lateral side wall sections, in which the lateral side wall sections of the outer liner layer are truncated compared with the inner liner layer and compared with the front and back wall sections of the outer liner layer;

said surfaces of the inner and outer liner layers being spherical where said surfaces of the inner and outer liner layers overlap for allowing rotational sliding movement of the inner liner layer against the outer liner layer;

the helmet shell having a non-spherical interior surface, and the outer liner layer being rotatable against the non-spherical interior surface of the helmet shell for absorbing rotational forces;

wherein a lower edge of each lateral side wall section of the outer liner layer includes a curve extending towards an apex of the helmet, wherein the outer liner layer has a total height, wherein a peak of the curve of each lower edge is located within a top half of the total height, wherein a midpoint of the curve of each lower edge is located within the top half of the total height, and wherein two endpoints of the curve of each lower edge are located within a bottom half of the total height; and at least one elastic connector comprising a rotation-limiting mechanism connecting the inner and outer liner layers together, the rotation-limiting mechanism being provided for limiting rotation between the inner and outer liner layers.

20. A helmet as claimed in claim 19, in which at least one of the internal surface of the outer liner layer and the external surface of the inner liner layer has recesses therein for weakening the layer and for facilitating crushing of the layer when a radial force is applied, thereby loosening the inner liner layer within the outer liner layer.

* * * * *